US008091716B2

(12) United States Patent
Bair

(10) Patent No.: US 8,091,716 B2
(45) Date of Patent: Jan. 10, 2012

(54) IMAGE DISPLAY SYSTEM

(76) Inventor: Helen Bair, Edina, MN (US)

( * ) Notice: Subject to any disclaimer, the term of this patent is extended or adjusted under 35 U.S.C. 154(b) by 970 days.

(21) Appl. No.: 11/219,468

(22) Filed: Sep. 2, 2005

(65) Prior Publication Data

US 2006/0186074 A1 Aug. 24, 2006

Related U.S. Application Data

(60) Provisional application No. 60/666,813, filed on Mar. 31, 2005, provisional application No. 60/647,228, filed on Jan. 26, 2005.

(51) Int. Cl.
*A47B 57/00* (2006.01)

(52) U.S. Cl. ..... 211/205

(58) Field of Classification Search ..... 211/205, 211/196, 13.1, 85.2; 40/530; D6/301
See application file for complete search history.

(56) References Cited

U.S. PATENT DOCUMENTS

D199,126 S * 9/1964 Jahn ..... D6/301
D199,291 S * 9/1964 Jahn ..... D6/301
3,424,313 A * 1/1969 Feibelman ..... 211/85.2
4,291,811 A * 9/1981 Shaver ..... 211/205
4,322,007 A * 3/1982 Feibelman ..... 211/163
4,399,626 A * 8/1983 Braverman et al. ..... 40/530
D444,633 S * 7/2001 Henick ..... D6/301
6,364,126 B1 * 4/2002 Enriquez ..... 211/13.1
6,811,836 B1 * 11/2004 Johnson et al. ..... 428/20
D530,102 S * 10/2006 Vincent ..... D6/301

* cited by examiner

*Primary Examiner* — Sarah Purol

(74) *Attorney, Agent, or Firm* — Mark A. Litman & Associates, P.A.

(57) ABSTRACT

A structure is provided having a base and relatively vertical structural support element (such as a post, pole, platform, stairs, etc.) from which extend arms that support removable image holders. The removable image holders may contain images that can be readily replaced. The removable image holders can restrain the images in six directions (up, down, forward, backward, left and right), although restraint may be effected by only friction or gripping, rather than an immovable wall. The removable image holders may be relatively secured to the arms, although they may easily swing for ease of viewing. The structure may have ornamentation thereon that is indicative of a theme (birthday, wedding, graduation, holiday, memorial, season, sports event and the like).

20 Claims, 3 Drawing Sheets

IMAGE DISPLAY SYSTEM

RELATED APPLICATIONS DATA

This Application claims priority from Provisional U.S. Patent Applications Nos. 60/666,813, filed Mar. 31, 2005 and 60/647,228, filed Jan. 26, 2005.

BACKGROUND OF THE ART

1. Field of the Invention

The present invention relates to the field of images, image displays, and especially thematic assemblies of image displays. The present invention particularly relates to an assembly that enables display of images (such as prints or photographs) and the ready exchange of images on the display.

2. Background of the Art

Collages, montages and displays of multiple images or photographs are well known in the art. Picture books allow for the display of multiple images on the same or opposing pages, and collages of multiple images lain on a single surface are common methods of displaying images.

It is also well known to provide commercial materials such as greeting cards to the consumer by placing them in stands with individual pockets from which the greeting cards may be removed by the consumer. Ordinarily, there are multiple card pockets, multiple cards in the pockets, and multiple pockets on individual arms on a central base. The arms may individually or collectively revolve about the central base. The cards are ordinarily stable in five directions (down, forward, backward, left and right) and must be freely moveable in the vertical direction to allow the consumer to remove and replace the cards for inspection or purchase.

The display of multiple images, particularly multiple images having a related theme has been relatively fixed in its technical development, with displays limited to two-dimensional displays, such as multiple images on a surface. Some frames have two images (back-to-back) with images displayed on opposite surfaces of a frame. Little more has been done in providing structures that provide novel systems for the display of multiple images, particularly multiple images with a related theme, and provide a structure in which the images may be readily replaced.

SUMMARY OF THE INVENTION

A structure is provided having a base and relatively vertical structural support element (such as a post, pole, platform, stairs, etc.) from which extend arms that support removable image holders. The removable image holders may contain images that can be readily replaced. The removable image holders can restrain the images in six directions (up, down, forward, backward, left and right), although restraint may be effected by only friction or gripping, rather than an immovable wall. The removable image holders may be relatively secured to the arms, although they may easily swing for ease of viewing. The structure may have ornamentation thereon that is indicative of a theme (birthday, wedding, graduation, holiday, memorial, season, sports event and the like).

DETAILED DESCRIPTION OF THE INVENTION

Figure 1:
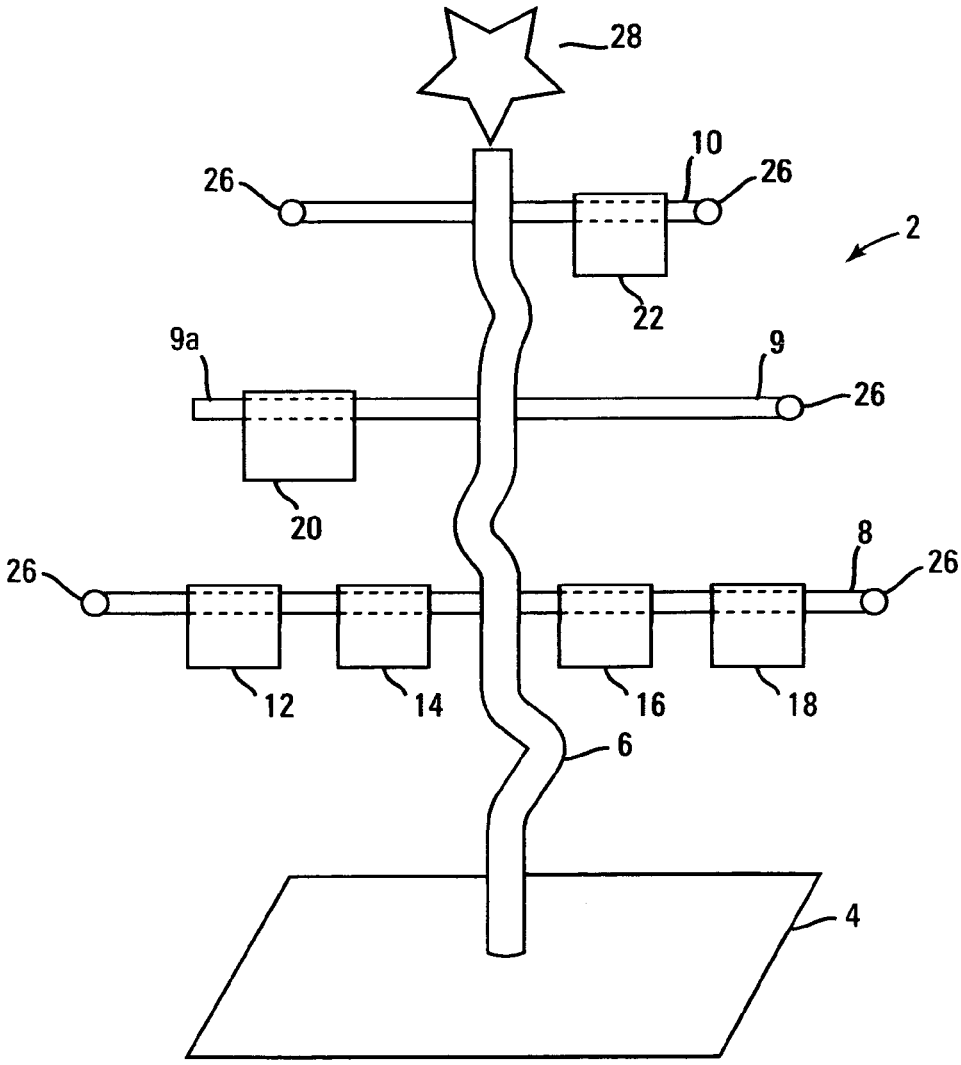
FIG. 1 shows a front view of an image display system within the generic scope of the present invention.

A physical structure is provided having a base or being connectable to a base and relatively vertical structural support element (such as a post, pole, platform, stairs, etc.) from which extend arms that support removable image holders. The base to which the vertical support is attached stabilizes the system and allows it to be free-standing. It is usually a relatively stable base and may be flat, conical with an edge that lies within a plane, shaped (e.g., round, oval, square, rectangular) and the like, and may be shaped to match the theme of the images (e.g., shaped like a diploma, a Christmas tree, etc.). If a base is not supplied with the support, the support may have attachment means associated with it, such as a screw extending from one end that can fix the support to any available base.

The support may most conveniently be a cylindrical or shaped-crossection pole, but may be curves, spiral, angular and the like. Its primary function is to provide a support for the arms that will support the images. The materials should be structurally sound, but beyond that, they do not need many other important criteria beyond aesthetics. The support sits on a base, and the support may be fixed (not rotating) on the base or the support may rotate with respect to the base. Additionally, the term base may include a single horizontal element or may include two horizontal elements that rotate with respect to each other so that the upper horizontal element (to which the support is attached) will rotate with respect to the lower horizontal element. In this manner, the support will be able to rotate with respect to the lower horizontal element freely. This rotation may be in both directions or by gears limited to one direction (or motor driven in one or both directions. The movement may be a full 360° or greater, or be restricted, if desired.

Extending from the central support are the arms, which may also be straight or curved. The arms provide structural support for the image holders. They must be structurally sound, and hold the weight of the images without breaking. Their aesthetics must also be considered. Materials such as wood, plastic, composite, metal and the like may be used for any of the structural elements of the base, support and arms. The arms may be simple posts extending from the support or may be curved. The arms may have consistent dimensions and diameters along their length, or may vary, depending upon the needs for enabling support of the image holders. For example, if the image holders (later described) are slid over the arms from their exterior towards the support, it facilitates movement if there is a relatively uniform dimension or diameter. If the arms support the image holder dependent upon local thickness, the thickness may vary to enable local support or for aesthetic reasons. Grooves, holes or notches may be placed in the arms to assist in supporting and/or stabilizing the location of the image holders. The arms may have restricting elements on the exterior ends (away from the support) to prevent image holders from sliding off the ends of the arms when not desired.

The image holders should be able to hold the images (e.g., prints, photographs or any other form of visible image on a substrate) so that it can be viewed from at least one direction. Preferably the image holder will be a two-sided display so that images will be visible from opposite surfaces (e.g., the front and back) of the images holder. It is possible to have a 3-sided or 4-sided pyramidal structure holding images, but that is less preferred. The image holder should be easily attached to the arms, and is either itself removable from the arms, or the holder and arms are removable from the support to facilitate insertion of and/or removal of the images. There are many different design alternatives available for the image holder, but simplicity and economy are desirable.

A simple design and structural combination for the base, support, arms and image holders comprises a stable square wooden base (e.g., 30 cm on an edge), a 1 m ling 2.6 cm diameter round pole wooden support that is attached (e.g., pegged into a hole or screwed in the base structure), four wooden arms comprising poles each having a diameter of 1 cm pegged or screwed into the support pole in an aesthetic distribution (the top arm having a length of 12 cm, the second arm a length of 18 cm, the third pole having a length of 24 cm, and the fourth pole having a length of 30 cm). The arms may be single poles passing through the support, or may be multiple poles attached to different surfaces (not necessarily, but optionally directly opposite or radially opposite a paired arm pole). Any number of arms may be provided as a designer's choice in the image support structure.

The image holders may be as simple as a transparent or translucent (e.g., matte finish) case (which allows insertion of individual or multiple images in a secure manner), a tensioned or hinged set of transparent plates, two plates with a curved tension providing edge, a rectangular case with an opening or openable edge into which images may be slid, a clasp securing flip container and the like. The image holder, as noted, should be transparent or translucent on the surfaces where the images are to be viewed. It is possible, but less preferred to have the surfaces of the images unprotected, and the images supported on flat surfaces (e.g., with two opposed edges sliding on grooves to support the image), but the use of protecting surfaces (e.g., the panels of a case or to-way transparent frame) that are transparent or translucent is preferred. The transparent surfaces may be transparent (or translucent) polymers such as polyester (e.g., Lexan® polyester or Lucite® polyester, polyacrylics, polyvinyl resins, silicone resins and the like, or glass.

As noted, the entire structure may be theme oriented. The simplest theme orientation would be as a Christmas tree or other tree. The extension of the arms, and additional decorations on the structure could make the overall appearance of the structure look like a diploma, a wedding cake, a star (e.g., for the fourth of July) or a performance event, piano or musical instrument, sports device (football, target, goal posts, etc.).

The image holders may simply slide over the arms through a hole of with a hook element that partially circles the arm. The end of the arm may be provided with a movement restricting element (e.g., a ball that screws onto the end of the arm and prevent the hole in the image holding device from sliding over the end of the arm. These and other aspects of the structure will become apparent from a review of the figures.

The removable image holders may contain images that can be readily replaced. The removable image holders can restrain the images in six directions (up, down, forward, backward, left and right), although restraint may be effected by only friction or gripping, rather than an immovable wall. The removable image holders may be relatively secured to the arms, although they may easily swing for ease of viewing. The structure may have ornamentation thereon that is indicative of a theme (birthday, wedding, graduation, holiday, memorial, season, sports event and the like).

FIG. 1 shows an entire image display structure 2 comprising a base 4 (which may be rigidly attached to the central support 6 or may allow rotation of the base with respect to the central support, as described above), a central support pole 6 (here shown as curved for visual effects), three arms 8, 9 and 10 and six image holders 12, 14, 16, 18, 20 and 22, although more or fewer image holders could be used. Movement restricting, detachable balls 26 are shown on the arms 8, 9 and 10, with no ball shown on the left side 9*a* of arm 9 where the image holder 20 has just been slid onto the left side 9*a*. A decorative star 28 is shown on the top of the structure 2. The number of arms and image holders in this figure are merely exemplary and are not intended to limit the scope of the invention. As indicated, the size and number of elements are a design choice.

Figure 2A:
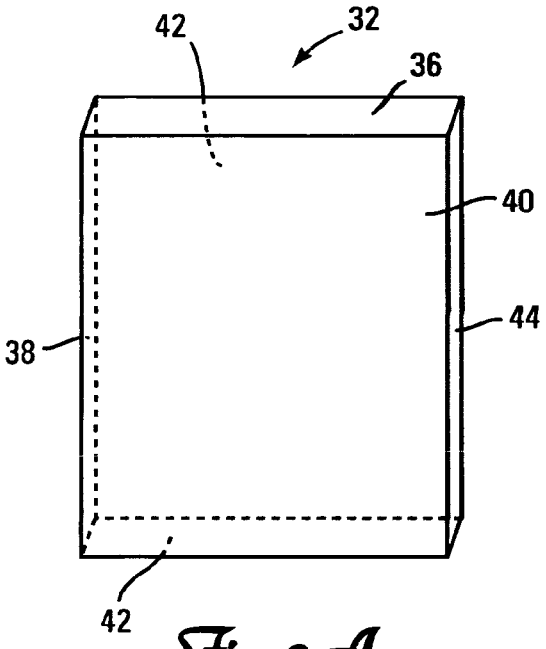
FIG. 2 shows a cutaway view of an image holder useful within an image display system within the generic scope of the present invention.

FIG. 2A shows a cutaway view of an image holder 30 useful within an image display system within the generic scope of the present invention. The image holder 30 is shown in two embodiments, 32 and 34. The image holder 32 comprises five solid surfaces, front panel 40, back panel 42, top panel 36, bottom panel 42 and left side panel 38. The right side 44 may be completely open or a dimensioned slit in a panel to allow for sliding images into or out of the image holder 32. A thumb slot (not shown) may be provided in this format to allow for digital access to the image to facilitate its insertion and removal.

Figure 2B:
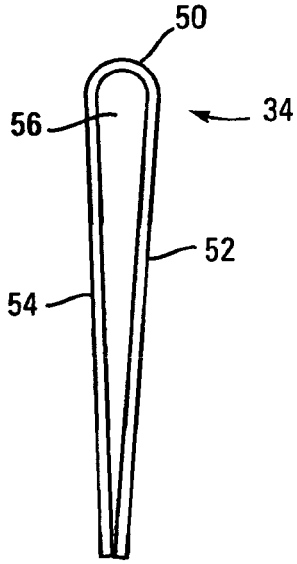

FIG. 2B shows a side view of an opened image holder 34. The image holder 34 comprises a flexible top loop portion 50, gripping windows 52 and 54 and a slide hole 56. The gripping windows 52 and 54 may be gently spread, a picture inserted, and released to firmly grip the images between the windows 52 and 54.

Figure 2C:
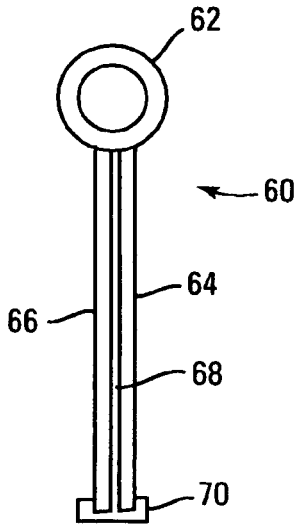

FIG. 2C shows an image holder 60 comprising a slide ring segment 62, two transparent windows 64 and 66 that define an image holding area 68 between transparent windows 64 and 66 and a locking member 70 to maintain the positioning of transparent windows 64 and 66 and prevent an image from sliding out the bottom of the image holder 60.

Figure 3:
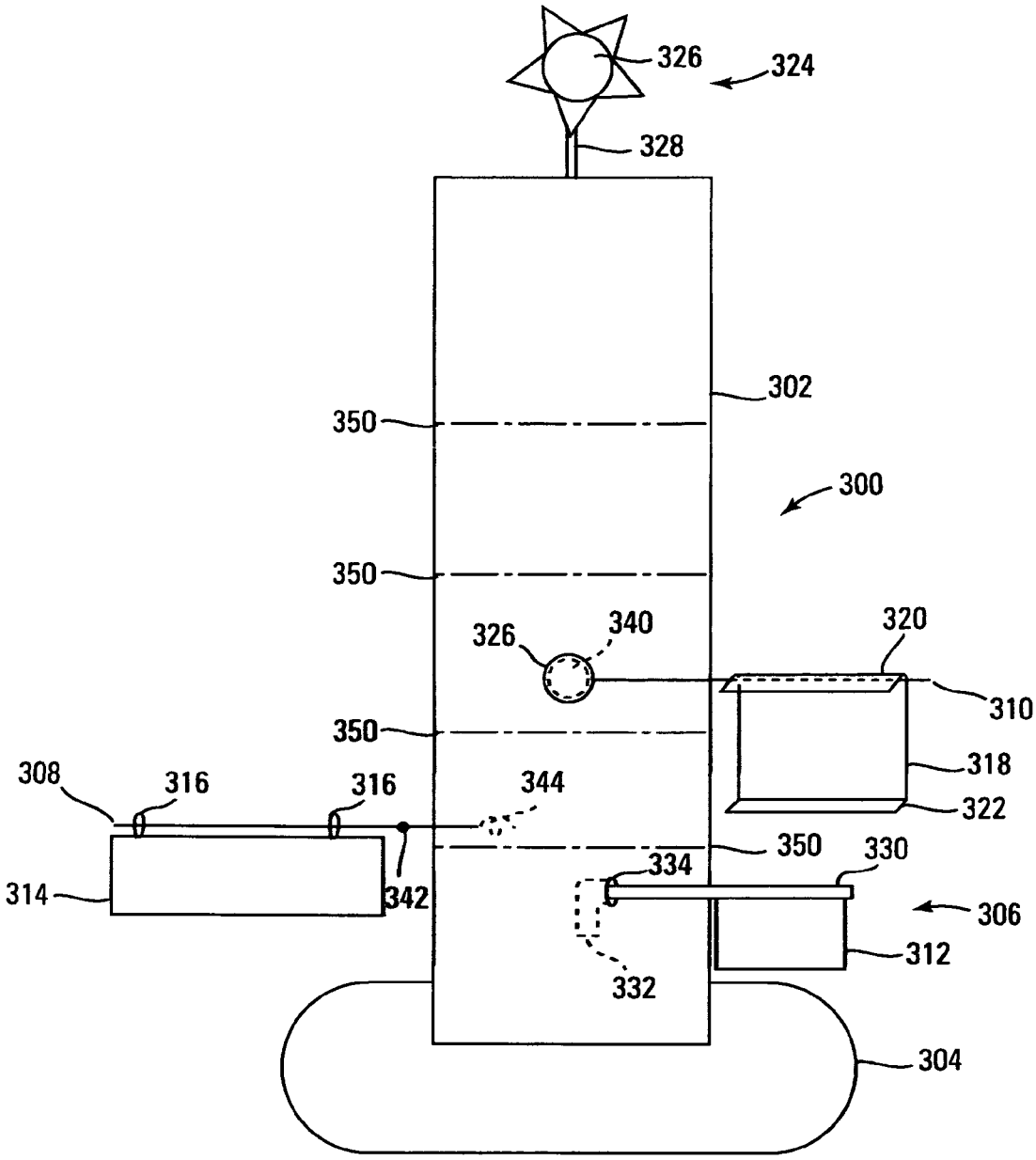
FIG. 3 shows a composite contruction of a display having alternative formats of image displays thereon.

FIG. 3 shows a composite construction of a display 300 having alternative formats of image displays thereon. The display 300 consists of a central support 302, a base 304 and three distinct image display support elements 330, 310 and 308. The entire display format component 306 comprises a rigid support member 330 on which is supported an image support element 312. The image support element 312 is shown with no fundamental attaching mechanism for the image display 312 and the rigid support rod 330 and any connecting system may work. The image support element 312 could even be a plastic sheet having pressure sensitive adhesive or repositionable pressure sensitive adhesive (e.g., Post-It® brand repositionable adhesive) on the surface, the plastic sheet adhered or mechanically secured (e.g., even stapled) to the rigid support rod 330. The rod 330 is shown to be stabilized against or to the central support by an engaging system comprising a hook 332 that is inserted into shaped accepting hole or slot 334 so that the rigid supporting rod 330 is supported against gravity. The support may be rigid so that the rod 330 does not move, pronate, rotate or shift, or it can be a more loose engagement where the image can be adjusted or moved within the connection to the hole 334.

A second format for engaging and support of an image is shown with semi-rigid rod 310 over which is draped the image containing element 318 which is hanging by extended lip 320 over the rigid support element 310, while a picture (not shown) would be supported by bottom lip 322 and secured also by the top lip 320 to keep the picture from falling off the display. The semi-rigid rod 310 is secured to the central support 302 by engagement with a gimbaling ball 340 engaged with a socket 346 in the central support 302. This engagement may swivel, pronate, elevate and the like, dependent upon the tightness of the fit between the ball 340 and the socket 346 which may have adjustable elements (not shown) to adjust the tightness of the movement of the ball 340 within the socket 346. The image support system may be a simple frame (for supporting an image) with a lip extending over the rod, which lip has a shape (e.g., arcuate or angled) or element (e.g., another lip at about 90 degrees) for extending over the rod and supporting the image, which may swing freely or be firmly positioned. The center support may have one pair, odd numbers, multiple pairs and multiple lengths of rods and image supports along its length, according to design intended.

A third format for engaging and support of an image is shown with elastically or inelastically bendable rod material 308 on which is supported an image 314 which is supported on rod 308 by simple loops 316 of material. The rod 308 is engaged with the center support 302 by a screw in system 344, in which the screw may be rigid or flexible and a hole (not shown) may be precut. The rod 308 is shown with a swivel point 342 for allowing movement of the image support 314. Individual rotation points 350 are shown on the center support 302 to allow sections of the center support to be rotated. This can assist in positioning images for view.

A top star display 324 with inserted image 326 is shown attached to the central support by a peg 328 which also may swivel or not. Holes (not shown) may be provided along the center support 302 to allow insertion of support rods at selected locations along the length of the center support 302.

The technology described herein may be generally characterized in the following non-limiting manner as a structure for displaying multiple images at the same time comprising: a vertical support element; at least one pair of arms extending generally away from the vertical support structure; at least one image holder supported on each arm of the at least one pair of arms. The at least one image holder may be:

a) removable from the vertical support structure;
b) capable of supporting and displaying an image on at least one surface such that the image may be removed without tearing the image; and
c) securing against movement of the image in at least five directions.

The structure may have the at least one image holder capable of supporting and displaying at least two images on opposed surfaces of the image holder such that the at least two images may be removed without tearing the images. The structure may also have the at least one image holder is removable from an arm that supports the at least one image holder. The at least one image holder is preferably removable from an arm that supports the at least one image holder. The image holder may have images inserted and removed therefrom without a locking element being used to secure the images, without permanent adhesives or typically aggressive pressure-sensitive adhesives that may damage the images. Repositionable adhesives such as Post-It® brand adhesives may be used. There may be a releasable movement restricting element on the arm to prevent the image holder from sliding of the arm. There may be multiple image holders present on at least one arm.

Although specific examples, designs and structures have been shown, one of ordinary skill in the art can redesign the structures, shapes and materials and retain the spirit of the novel technology described herein and be within the practice of the claimed invention. For example, the connection of the support to the base may be structured to swivel and/or pivot, the support may be deformable while retaining its support strength, the arms may swivel, pivot or rotate about the support, and the like. In FIG. 1, the left arm 9*a* and the right arm 9 comprise a pair of arms, but may be referred to as a single level of arms in describing the total structure. In FIG. 1, therefore, three levels of arms are shown, and each level may be considered individual pairs of arms, providing six arms to the total structure shown.

What is claimed:

1. A structure for displaying multiple images at the same time, at least some images consisting of an image on a 2-dimensional support, the structure comprising:

a vertical support element;

at least one pair of arms extending generally away from the vertical support structure;

at least one image holder supported on each arm of the at least one pair of arms;

the at least one image holder:

a) being removable from the vertical support structure;

b) the at least one image holder having two pairs of opposed edges forming a transparent face through which an image may be viewed and displaying an entire at least one image on a 2-dimensional support on at least one entire surface of the image holder such that the entire image-containing element and its 2-dimensional support is viewed through the entire surface of the image holder and is manually slideable from the image holder without tearing the image; and c) secures against movement of the image in at least five directions consisting of vertical support, left support, right support, forward support and backward support.

2. The structure of claim 1 wherein the at least one image holder supports and displays from within that at least one image holder at least two entire images through entire opposed surfaces of the image holder such that the at least two images may be removed without tearing the images.

3. The structure of claim 1 wherein the at least one image holder supported by a top of an arm is removable from the arm that supports the at least one image holder by sliding the at least one image holder along the top of the arm.

4. The structure of claim 2 wherein the at least one image holder supported by a top of an arm is removable from the arm that supports the at least one image holder by sliding the at least one image holder along the top of the arm and the image holder has five solid surfaces consisting of a front panel, back panel, top panel, bottom panel and side panel.

5. The structure of claim 3 wherein the image holder has an opening into which opening images are inserted and secured without a locking element being used to secure the images.

6. The structure of claim 3 wherein a releasable movement restricting element is on the arm to prevent the image holder from sliding off of the arm.

7. The structure of claim 3 wherein a releasable movement restricting element is on the arm to prevent the image holder from sliding off of the arm.

8. The structure of claim 3 wherein multiple image holders are present on at least one arm.

9. The structure of claim 4 wherein multiple image holders are present on at least one arm.

10. The structure of claim 3 having at least three pairs of arms supporting at least one image holder on each arm.

11. The structure of claim 4 having at least three pairs of arms supporting at least one image holder on each arm.

12. The structure of claim 5 having at least three pairs of arms supporting at least one image holder on each arm.

13. The structure of claim 6 having at least three pairs of arms supporting at least one image holder on each arm.

14. A structure for displaying multiple 2-dimensional images on a support at the same time comprising:

a vertical support element;

at least one pair of arms extending generally away from the vertical support structure;

at least one image holder supported on each arm of the at least one pair of arms;

the at least one image holder being:

removable from the vertical support structure;

the at least one image holder having two pairs of opposed edges forming a transparent face through which an image may be viewed and supporting and displaying an entire 2-dimensional image element and support on at least one entire surface of the image holder such that the entire 2-dimensional image element is viewed through an entire front surface between the two pairs of opposed surfaces and manual removal of the 2-dimensional image and support occurs without tearing of the 2-dimensional image and support;

the image holder comprising a sheet of transparent plastic having an extended lip above an image-holding area that slides across an arm and a lower surface that supports an image so that the supported image and support slides along the lower surface with vertical support from the lower surface.

15. The structure of claim 14 wherein there is no surface opposing the entire front surface on the image holder.

16. The structure of claim 14 wherein there is a back surface opposing the entire front surface on the image holder through which an entire second image may be viewed.

17. The structure of claim 14 wherein the image is a photograph and is a flat sheet of front and back of the photograph.

18. A structure for displaying multiple images at the same time comprising:

a flat base of a first material;

a vertical support element of the first material;

at least one pair of arms extending generally away from the vertical support structure;

at least one image holder of a second material that is transparent supported on each arm of the at least one pair of arms, the at least one image holder having two pairs of opposed edges forming a transparent face through which an image may be viewed;

the at least one image holder consisting of polymeric materials:

a) being removable from the vertical support structure:

b) the image being entirely between both opposed edges such that the at least one image holder displays an entire image and its support on at least one entire transparent surface of the image holder such that the image and support is viewed through the entire surface and is manually removeable from the holder without tearing the image; and secures against movement of the image and the support by five separate surfaces in at least five directions consisting of vertical support, left support, right support, forward support and backward support.

19. The structure of claim 18 wherein the first material is wood.

20. The structure of claim 19 wherein the transparent material is selected from the group consisting of polyester, polyacrylics, polyvinyl resins, silicone resins.

* * * * *